United States Patent [19]

Lovrenich

[11] 4,381,133

[45] Apr. 26, 1983

[54] VARIABLE CENTER DISTANCE TERMINAL STRIP AND METHOD OF MAKING SAME

[75] Inventor: Rodger T. Lovrenich, Santa Teresa, N. Mex.

[73] Assignee: Cooper Industries, Inc., Houston, Tex.

[21] Appl. No.: 250,295

[22] Filed: Apr. 2, 1981

[51] Int. Cl.[3] ..... H01R 9/10

[52] U.S. Cl. ..... 339/198 R

[58] Field of Search ..... 339/59 R, 59 M, 198 R, 339/198 C, 198 E, 198 GA, 198 K, 198 S, 198 P, 276 SF; 206/343, 347

[56] References Cited

U.S. PATENT DOCUMENTS 3,512,121 5/1970 Bergeron ..... 339/198 E 4,236,778 12/1980 Hughes et al. ..... 339/198 H

*Primary Examiner*—Joseph H. McGlynn

*Assistant Examiner*—Paula Austin

*Attorney, Agent, or Firm*—Brown & Martin

[57] ABSTRACT

An electrical terminal strip is formed from a substantially flat ribbon of flexible material that is scored at intervals to provide fold points. Electrical terminals are provided between the fold points and affixed to the ribbon with pins extending below the ribbon for making an electrical connection such as a connection to a printed circuit board. The desired number of barriers is selected and the strip is cut to the proper length. The strip is folded at the fold points to form upwardly extending barriers, and is adjusted longitudinally to provide the desired center between the terminals.

7 Claims, 4 Drawing Figures

VARIABLE CENTER DISTANCE TERMINAL STRIP AND METHOD OF MAKING SAME

BACKGROUND OF THE INVENTION

The invention relates to devices known as terminal strips or barrier strips wherein a wire connection is made at the top of a block of insulating material by an element such as a screw, and a different type of connection; such as a solder joint to a printed circuit board, a quick connect, or a wire wrap; is made at another location such as the bottom of the strip. The invention is particularly adapted for printed circuit board connections.

Conventional terminal strips embody a fairly thick, comparatively rigid block of material such as Nylon. Openings are provided at regular intervals in the block to seat metal terminals which have screws inserted in the top for a wire connection. The terminal strip is identified by the center distance between the terminals. Typical examples are 0.325 inch, ⅜ inch, and 7/16 inch. Barriers on the block extend upwardly between adjacent terminals to prevent electrical arcing between the terminals. Some kind of connecting means such as a pin extends from the terminal below the block to make the second connection. In printed circuit board applications, this pin is relatively short and extends into, or no more than a short distance through, the printed circuit board.

The terminal strip block is formed in an intricate, expensive mold which is utilized in an expensive injection molding machine. Items such as fire retardent additive and color additive cause difficulty in the molding process.

At least one mold must be made for each size of terminal strip such as the 0.325 inch, the ⅜ inch, and the 7/16 inch strip mentioned above. In addition, terminal strips are sold in various lengths such as two terminals long to 36 terminals long. This difficult product mix must be handled either by sawing long stock blocks of plastic to the desired length or molding each length strip in a different mold. Molding to length for all possible sizes is economically prohibitive because of the staggering mold costs and set up time. The preferable alternative of sawing to length from a longer stock strip, and trimming and sanding the ends also adds considerable cost to the strip.

SUMMARY OF THE INVENTION

Accordingly, it is an object of the invention to provide a new and improved electrical terminal strip which utilizes a minimum amount of material and which is low in cost.

It is another object of the invention to provide such a new and improved electrical terminal strip which can be quickly and easily adjusted to different terminal center distances when being installed.

It is another object of the invention to provide such a new and improved variable center distance electrical terminal strip which can be quickly cut to the desired length from a continuous ribbon and then attached in place to a work piece at the work site without complicated and expensive tooling.

It is a further object of the invention to provide a new and improved method of forming a terminal strip which can be configured at the work site to quickly provide the desired number of barriers and establish a choice of center distances between the terminals.

The invention departs from the standard injection molded plastic block and utilizes a continuous, substantially flat ribbon of flexible, dielectric material. Although the material is flexible, it is not limp. The plastic ribbon is scored at intervals so that barriers can be folded upward from the ribbon at the scored portions.

Terminals are affixed to the ribbon between the scored portions and have pins extending below the strip to make a connection to a device such as a printed circuit board.

The strip can be formed and used at the work site by cutting the desired length from the ribbon to form the preselected number of barriers. The ribbon is adjusted longitudinally at the work site to the desired center distance and the pins are inserted into openings in the connector pads of a printed circuit board for example.

The continuous ribbon can be stored at the work site in the form of a roll. As different jobs appear at the work site requiring different center distances and/or different terminal strip lengths, the proper length is cut from the continuous ribbon and is adjusted longitudinally to the center distance currently required.

DETAILED DESCRIPTION OF THE INVENTION

Figures 1, 2, 3, 4:
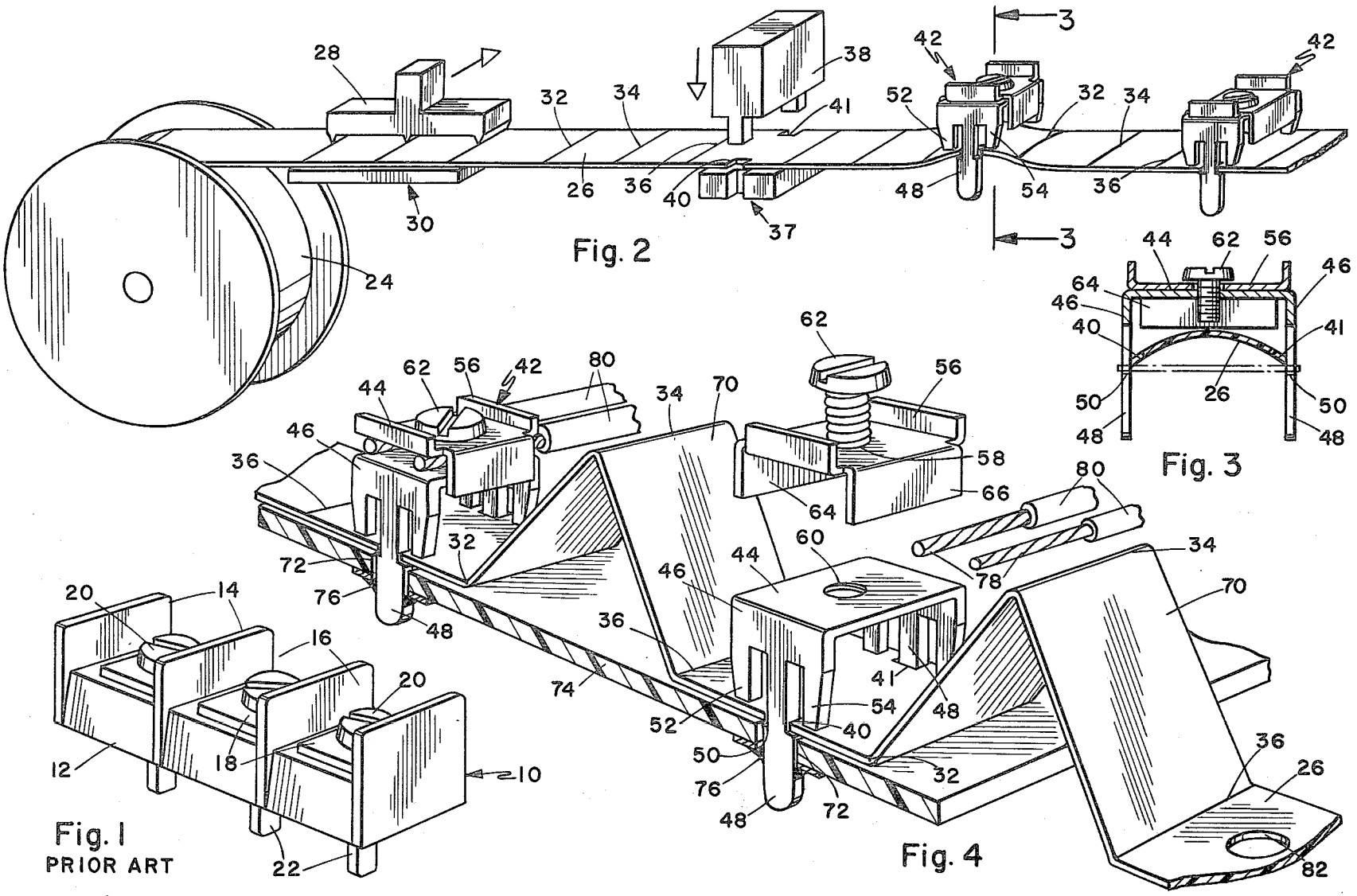
Fig. 1 PRIOR ART
FIG. 1 is a perspective view of a conventional terminal strip.
FIG. 2 is a schematic view demonstrating the scoring of the plastic ribbon, the notching of the plastic ribbon, and the insertion of terminals into the ribbon.
FIG. 3 is an enlarged sectional view taken on line 3—3 of FIG. 2.
FIG. 4 is a perspective view, partially exploded and partially sectioned, showing the terminal strip with barriers folded into position and the terminals soldered to a printed circuit board.

Referring to FIG. 1 of the drawings, a conventional terminal strip is shown at 10. The terminal strip includes a molded, relatively thick, plastic insulating body 12, made of a material such as Nylon, with barriers 14 extending upwardly therefrom. Each pair of barriers forms a terminal station or pocket 16. A metal, electrically conductive terminal 18 is seated in each pocket. The terminal includes a screw 20 for holding a wire in electrical contact with the terminal, and a tail 22 extending beneath the body 12 of the terminal strip for connection to a printed circuit board.

The terminal strip means of the present invention is shown in FIGS. 2, 3 and 4 of the drawings. A roll 24 of flexible plastic ribbon is shown on the left side of FIG. 2. The word "ribbon" as it is used herein means a strip of flexible type material, such as a suitable plastic, whose width is several times greater than its thickness and which has standup rigidity. "Standup Rigidity" is used herein to define the characteristics of a suitable ribbon that is flexible enough to bend into rolls and to pinch sideways but stiff enough to form standing barriers which will not collapse in normal use. Polypropylene and Nylon are suitable materials.

The plastic ribbon 26 is moved off the roll 24 into position at the scoring station 30 (FIG. 2) and the scoring tool 28 is moved down and across the ribbon 26 to score three shallow depressions or lines 32, 34 and 36 in the ribbon 26.

The ribbon is then moved to the right in the drawing to the notching station 37 where a notching tool 38 is moved downward along the edges of the ribbon to form the opposing notches 40 and 41.

An electrical terminal 42 is then affixed to the ribbon 26 at the terminal insert station. The terminal (FIG. 3) includes a platform 44 with a blocking portion 46 folded down along each side. A pin 48 extends downward on each side and has shoulders 50 formed thereon which are wider than the notches 40 and 41 in the ribbon 26. A pair of seating legs 52 and 54 (FIG. 4) extend downwards one on each side of the pin 48. The distance between the ends of the seating legs 52 and 54 and the shoulders 50 is only slightly larger than the thickness of the ribbon 26. A wire clamp 56 is positioned over the terminal 18 and includes a central opening 58 which is aligned with a threaded opening 60 in the terminal. A screw 62 extends through the opening 58 in the wire clamp and is in threaded engagement with the opening 60. The wire clamp 56 includes downwardly extending tabs 64 and 66 which engage the terminal to prevent the wire clamp from rotating when the screw is turned.

As shown in FIGS. 2 and 3, the edges of the ribbon 26 are pressed inward toward each other and the ribbon is bunched up at the terminal insert station, and the pins 48 are positioned in the notches 40 and 41 on the edges of the ribbon 26. The ribbon 26 is then allowed to expand back and the seating legs 52 and 54 engage the top of the ribbon and the shoulders 50 engage the bottom of the ribbon to hold the terminal in position. The side walls of the notches 40 and 41 prevent the terminal from sliding longitudinally. The ribbon 26 with the terminals 42 attached is wound onto a suitable roll, not shown.

The supply roll may be taken to the point of assembly where a terminal strip is to be used. This is demonstrated in FIG. 4 of the drawings. The plastic ribbon 26 is compressed longitudinally and the ribbon folds at the score lines 32, 34 and 36 to form an upwardly extending barrier 70. The pins 48 are inserted through openings 72 in a printed circuit board 74. The pins 48 are wave soldered to the foil side of the printed circuit board in conventional fashion as indicated at 76.

A typical wire connection can be made at the top of the terminal strip by inserting the bare end 78 of wire 80 between the platform 44 on top of terminal 42 and the bottom of wire clamp 56. The wire cannot be inadvertently inserted beneath the terminal because of the blocking portion 46. The screw is tightened into the terminal 42 and the end of the screw extends into the opening beneath the platform 44 on terminal 42. Any number of barriers can be provided by cutting the proper length of plastic ribbon. The center distance between terminals is established by contracting or expanding the ribbon longitudinally. If the next job at the work station requires a different center distance and/or different numbers of barriers, this can be provided from the same supply roll. Also, if desired, different center distances can be provided on the same terminal strip.

Hold-down openings 82 (FIG. 4) can be provided in the ribbon to accommodate fasteners for affixing the ribbon 26 to a work piece.

The invention has been described in a preferred embodiment. It will be appreciated by those skilled in the art that variations from this embodiment can be made without departing from the scope of the invention.

I claim:

1. Variable center distance electrical terminal strip means, comprising:

a substantially flat ribbon of flexible electrical insulating material folded at intervals on fold areas thereon for providing upwardly extending barrier means; and a plurality of electrical terminal means for connection to said ribbon between said barrier means and having connection means above said ribbon for making a first connection, and pin means extending below said ribbon for making a second connection;

said ribbon being adjustable lengthwise for establishing the center distance between said terminal means.

2. Variable center distance electrical terminal strip means according to claim 1 wherein each fold area includes three adjacent scored portions extending across said ribbon.

3. Variable center distance electrical terminal strip means according to claim 1 wherein said ribbon includes opposed notches in the edges thereof between said fold areas; and each of said terminal means includes terminal seating means engaging the top of said ribbon, and a pair of legs positioned one in each of said notches, each of said legs including retaining means for retaining said terminal means on said ribbon against said seating means.

4. Variable center distance electrical terminal strip means according to claims 1 and 3 wherein said terminal means includes blocking means substantially parallel to the edges of said ribbon for preventing insertion of a wire beneath said terminal means.

5. Variable center distance electrical terminal strip means according to claim 4 wherein said terminal seating means positions the top of said terminal means above said ribbon in spaced relation thereto; clamp means in positioned atop said terminal means, said clamp means including downwardly extending sides overlying said terminal means and facing said barrier means and open ends facing in the same direction as the ribbon edges; and screw connection means extends through an opening in said clamp means in threaded engagement with the top of said terminal means.

6. Variable center distance electrical terminal strip means comprising:

a substantially flat ribbon of flexible insulating material, said ribbon having barriers folded upwardly therefrom and opposed notches along the edges thereof between said barriers; and terminal means positioned between said barriers, each of said terminal means including a platform with a downwardly extending pin on each of two sides thereof, a pair of seating legs shorter than the pin, one on each side of each pin and spaced sidewise therefrom, said seating legs engaging the top of said ribbon, and said pins being positioned in said notches; and shoulder means on each of said pins positioned lower than the ends of said legs, said shoulder means being wider than the notch in said ribbon for engaging the bottom of said ribbon;

wherein the terminals are held in position on said ribbon by the shoulder means on the bottom of the ribbon and the positioning legs on the top of said ribbon.

7. Variable center distance electrical terminal strip means according to claim 6 wherein each terminal means includes blocking means on the sides thereof adjacent said pins for preventing the insertion of a wire below said terminal means, and clamp means is located atop said terminal means, said clamp means having an opening therein, downwardly extending sides, and open ends facing in the same direction as the edges of said ribbon; and screw means extends through the opening in said clamp means into threaded engagement with said terminal means.

* * * * *